US010376060B2

(12) United States Patent
Marcantoni

(10) Patent No.: US 10,376,060 B2
(45) Date of Patent: Aug. 13, 2019

(54) WALL HUGGER RECLINER

(71) Applicant: CIAR S.P.A., Pesaro (IT)

(72) Inventor: Egidio Marcantoni, Pesaro (IT)

(73) Assignee: CIAR S.P.A., Pesaro (IT)

( * ) Notice: Subject to any disclaimer, the term of this patent is extended or adjusted under 35 U.S.C. 154(b) by 269 days.

(21) Appl. No.: 15/258,317

(22) Filed: Sep. 7, 2016

(65) Prior Publication Data

US 2017/0071344 A1 Mar. 16, 2017

(30) Foreign Application Priority Data

Sep. 15, 2015 (EP) ..... 15185187

(51) Int. Cl.

| | |
|---|---|
| ***A47C 1/02*** | (2006.01) |
| ***A47C 1/03*** | (2006.01) |
| ***A47C 7/50*** | (2006.01) |
| ***A47C 1/029*** | (2006.01) |
| ***A47C 1/032*** | (2006.01) |
| ***A47C 1/035*** | (2006.01) |

(Continued)

(52) U.S. Cl.

CPC ..... *A47C 1/029* (2013.01); *A47C 1/0242* (2013.01); *A47C 1/032* (2013.01); *A47C 1/035* (2013.01); *A47C 1/0342* (2013.01); *A47C 1/0345* (2013.01); *A47C 1/03211* (2013.01); *A47C 7/506* (2013.01)

(58) Field of Classification Search

CPC ..... A47C 1/024; A47C 1/0242; A47C 1/0244; A47C 1/032; A47C 1/03211; A47C 1/03222; A47C 1/0345; A47C 1/035; A47C 1/0355; A47C 1/0342; A47C 1/029; A47C 1/023; A47C 7/506; A47C 7/5066; A47C 7/5068

USPC ..... 297/68, 69, 83, 85 R

See application file for complete search history.

(56) References Cited

U.S. PATENT DOCUMENTS 2,918,111 A * 12/1959 Schliephacke ..... A47C 1/0347 297/88
3,429,612 A * 2/1969 Cobb ..... A47C 1/0342 297/423.19

(Continued)

FOREIGN PATENT DOCUMENTS

BE 1009147 A3 * 12/1996 ..... A47C 1/0242
CN 104287492 A 1/2015

(Continued)

OTHER PUBLICATIONS

Machine Translation BE1009147A3, espacenet; http://translationportal.epo.org/emtp/translate/?ACTON=description-retrieval&COUNTRY=BE&ENGINE=google&FORMAT=docdb&KIND=A3&LOCALE=en_EP&NUMBER=1009147&OPS=ops.epo.org/3.2& SRCLANG=nl&TRGLANG=en, Aug. 3, 2018 (Year: 2018).*

*Primary Examiner* — Ryan D Kwiecinski

(74) *Attorney, Agent, or Firm* — Renner Kenner Greive Bobak Taylor & Weber

(57) ABSTRACT

A wall hugger recliner with zero space technology includes a frame for placing on a floor, a seat, a backrest, a foot support, and a foot support adjustment mechanism having a first mechanical rod assembly and a first actuator for deploying and retracting the foot support. A seat backrest adjustment mechanism includes a second mechanical rod assembly for adjusting the seat and the backrest with an upright basic position into a horizontal position, wherein the seat backrest adjustment mechanism has a second actuator for adjusting the seat and the backrest.

8 Claims, 5 Drawing Sheets

(51) Int. Cl.
*A47C 1/034* (2006.01)
*A47C 1/024* (2006.01)

(56) References Cited

U.S. PATENT DOCUMENTS

| | | | | |
|---|---|---|---|---|
| 6,840,575 | B2 * | 1/2005 | Hesse | A47C 1/0355 297/75 |
| 2011/0282495 | A1 * | 11/2011 | Fischer | B60N 2/0224 700/275 |
| 2013/0062914 | A1 | 3/2013 | Marshall | |
| 2015/0375865 | A1 * | 12/2015 | Fischer | B60N 2/919 701/49 |
| 2016/0332541 | A1 * | 11/2016 | Bowen | B60N 2/995 |
| 2016/0367030 | A1 * | 12/2016 | Donovan | A47C 1/0242 |

FOREIGN PATENT DOCUMENTS

| | | | | |
|---|---|---|---|---|
| DE | 20106560 | U1 | 8/2002 | |
| EP | 1712154 | A1 | 10/2006 | |
| JP | 2014012075 | A * | 1/2014 | A47V 1/035 |
| WO | WO-2014006768 | A1 * | 1/2014 | A47C 1/035 |
| WO | WO-2017066610 | A1 * | 4/2017 | A47C 1/03211 |

* cited by examiner

WALL HUGGER RECLINER

TECHNICAL FIELD

The invention relates to a wall hugger recliner which has zero space technology and which is distinguished in that it can be placed with small spacing from a wall and can be moved by means of a special seat backrest adjustment mechanism from an upright position into a horizontal position, without the backrest coming into contact with the wall. This is achieved in that, when the backrest is inclined in a backward direction, the seat is at the same time moved forwards.

BACKGROUND OF INVENTION

In this regard, embodiments are commercially available in which the adjustment of the wall hugger recliner from an upright basic position into a horizontal position is carried out simply by means of weight displacement. In many embodiments, independently of or synchronously with the adjustment of the seat and backrest, a foot support is also deployed or retracted.

SUMMARY OF THE INVENTION

An object of the invention is to provide a wall hugger recliner which provides new handling and/or configuration possibilities.

The wall hugger recliner according to the invention substantially comprises a frame for placing on a floor, a seat, a backrest and a foot support and a foot support adjustment mechanism having a first mechanical rod assembly and a first actuator for deploying and retracting the foot support and a seat backrest adjustment mechanism having a second mechanical rod assembly for adjusting the seat and the backrest from an upright basic position into a horizontal position, wherein the seat backrest adjustment mechanism has a second actuator for adjusting the seat and the backrest.

As a result of the two actuators, the comfort during handling is increased.

According to a specific embodiment of the invention, the seat backrest adjustment mechanism enables the seat to be moved from the upright basic position into a first intermediate position, wherein the clear spacing of the front end of the seat from the floor in the upright position is less than in the first intermediate position. At the same time, the seat backrest adjustment mechanism brings about a displacement of the seat in the direction towards the front end thereof when the wall hugger recliner is moved from the upright basic position into the first intermediate position.

According to another embodiment of the invention, the clear spacing with respect to the floor, which spacing is required to deploy and retract the foot support, is greater than the clear spacing available in the upright basic position and less than the clear spacing available in the first intermediate position. This embodiment either enables a corresponding extension of the foot support by the extent to which the front end of the seat is lifted from the upright basic position into the intermediate position or alternatively affords the possibility of lowering the seat accordingly with the foot support length remaining the same, whereby new configuration possibilities are afforded. It is thus, for example, possible by lowering the seat carrier to bring about a corresponding enlargement of the seat upholstery and consequently an increase of the seating comfort. It is naturally also possible to take an intermediate path and both to construct the foot support to be slightly longer and also to lower the seat carrier slightly.

So that the foot support does not come into contact with the floor when being deployed and retracted, in a preferred embodiment of the invention there is provided a sensor or a switch which identifies whether the wall hugger recliner is located in a region between the upright basic position and the first intermediate position or in a region from the first intermediate position and the horizontal position. The sensor or switch is in this instance, for release or blocking, connected to the first actuator in order to deploy and retract the foot support, a deployment and retraction operation of the foot support being blocked when the wall hugger recliner is still in a region between the upright basic position and the first intermediate position. The sensor or switch may in this instance be arranged at any suitable location which identifies whether the clear spacing with respect to the floor is sufficient for deployment or retraction of the foot support. It is particularly appropriate to carry out the fitting to the second actuator in order to adjust the seat and the backrest or in the region of the second mechanical rod assembly of the seat backrest adjustment mechanism.

The seat or the seat carrier thereof is provided with a first transverse carrier, whilst the foot support adjustment mechanism has a second transverse carrier so that the first actuator can be arranged between the first and second transverse carrier. When the first actuator is actuated, the first and second transverse carriers move relative to each other, whereby the deployment and/or retraction of the foot support relative to the seat is brought about. Accordingly, the seat backrest adjustment mechanism has a third transverse carrier, the second actuator being arranged between the first transverse carrier and the third transverse carrier. The seat backrest adjustment mechanism is connected in an articulated manner to the fixed frame of the wall hugger recliner so that an actuation of the second actuator brings about a movement of the seat and backrest relative to the fixed frame of the wall hugger recliner.

Both actuators are consequently supported on the commonly used first transverse carrier so that a very compact structural shape is produced.

BRIEF DESCRIPTION OF THE DRAWINGS

Other embodiments of the invention are explained in greater detail with reference to the following description and the drawings, in which.

DETAILED DESCRIPTION OF ILLUSTRATIVE EMBODIMENTS

Figure 1:
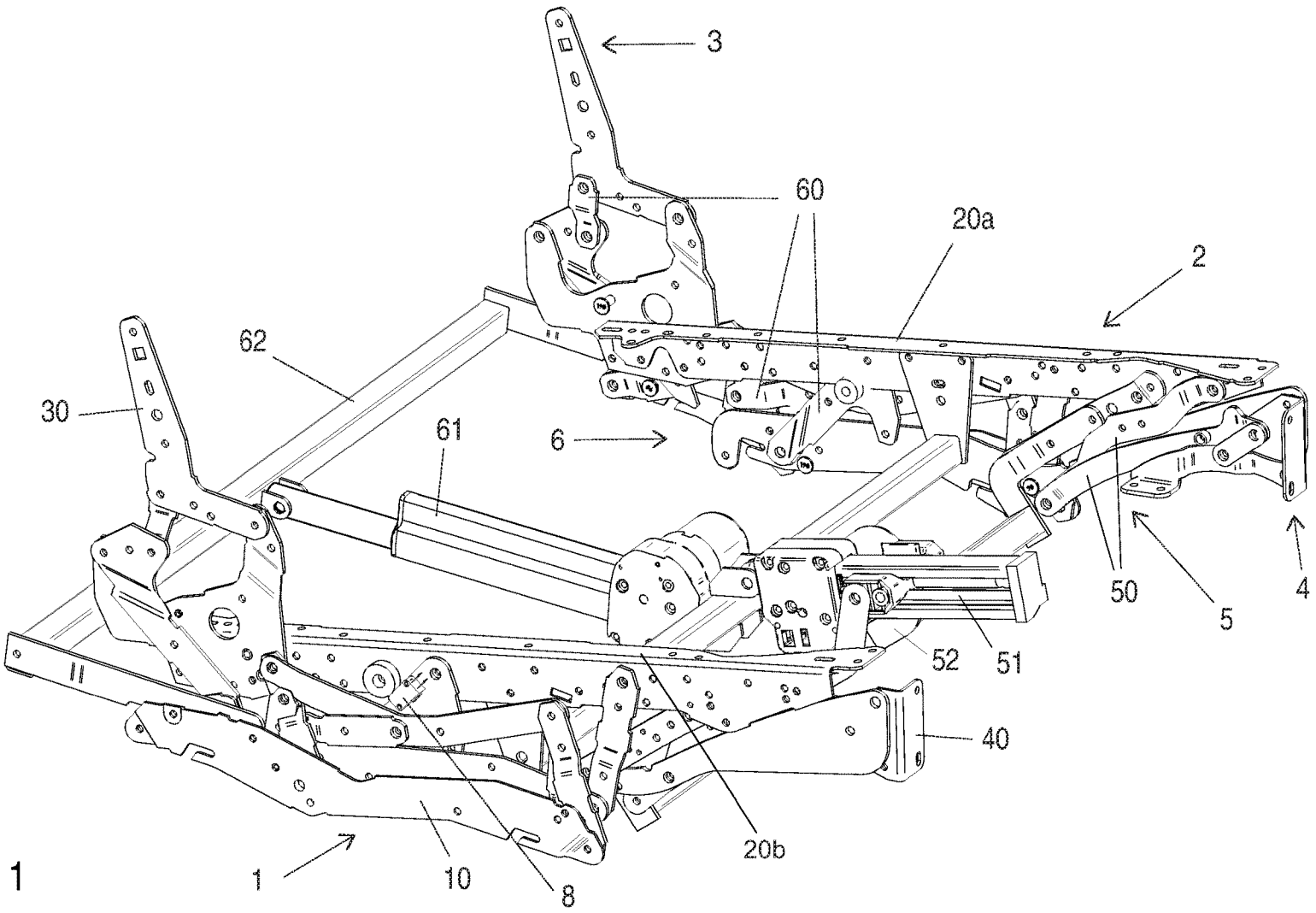
FIG. 1 is a schematic illustration of the adjustment mechanisms of the wall hugger recliner in the upright basic position with the foot support retracted.

With regard to the wall hugger recliner, only the components relevant to the adjustment of the wall hugger recliner are illustrated in the Figures. Any upholstery members of the backrest and seat and also the remaining body of the wall hugger recliner are not illustrated in greater detail here. The wall hugger recliner has for placing on a floor a frame 1, only a fixed frame portion 10 of which is shown here. There is further provided a seat 2 which is illustrated here by means of the seat carrier 20 thereof, a backrest 3 which is illustrated by means of the backrest carrier 3 thereof, and a foot support 4 which is illustrated by means of the foot support carrier 40 thereof.

For deployment and retraction of the foot support 4, there is provided a foot support adjustment mechanism 5 which has a first mechanical rod assembly 50 and a first actuator 51. The first mechanical rod assembly 50 is articulated in the region of the seat carrier 20. In order to adjust the seat 2 and the backrest from an upright basic position in a horizontal position, a seat backrest adjustment mechanism 6 having a second mechanical rod assembly 60 and a second actuator 61 is accordingly provided. The second mechanical rod assembly 60 connects the seat carrier and the backrest and is connected to the fixed frame portion 10 in an articulated manner.

Figure 2:
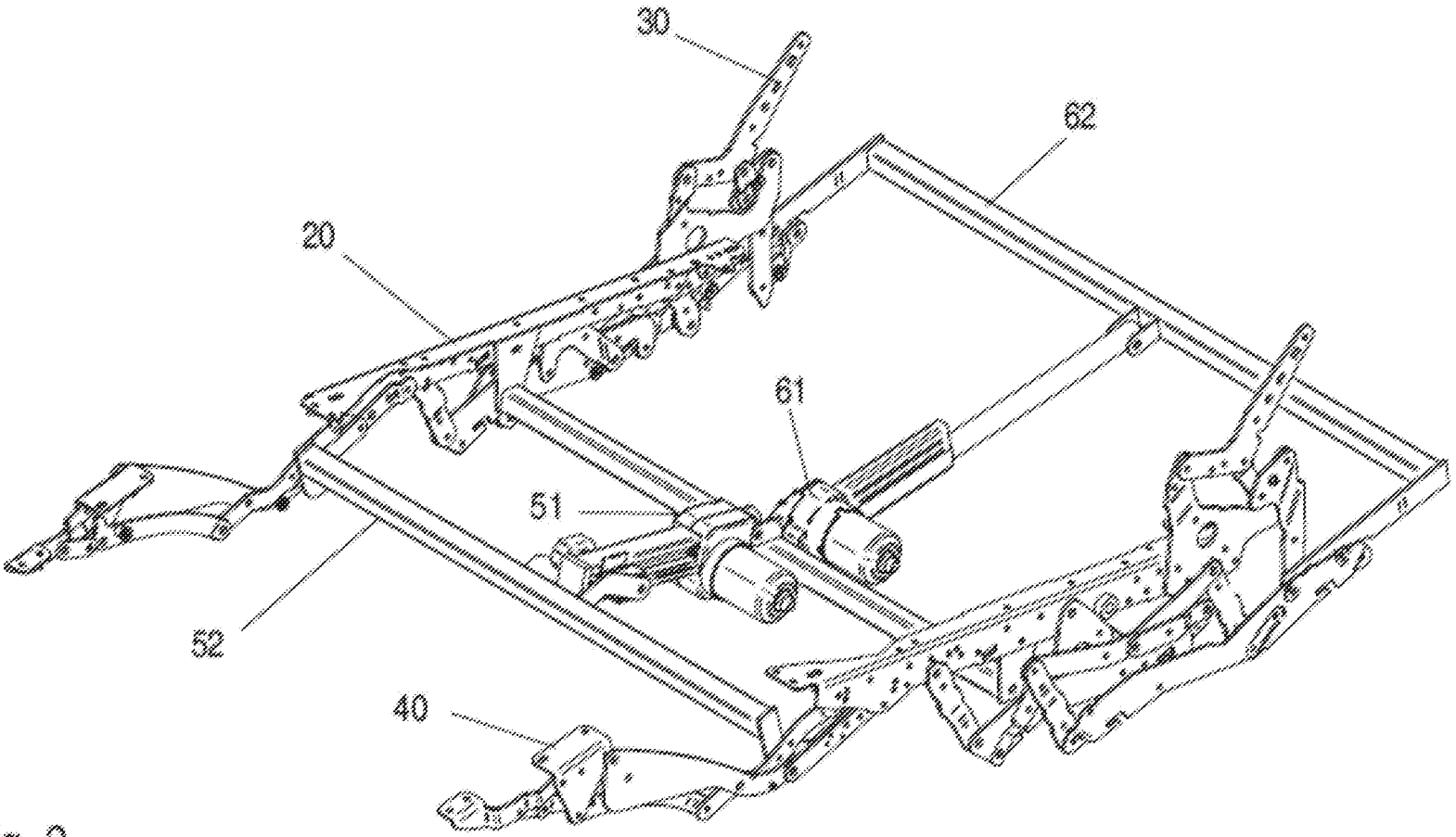
FIG. 2 is a schematic illustration of the adjustment mechanisms of the wall hugger recliner in the horizontal position with the foot support deployed.

In the embodiment illustrated, the seat carrier 20 comprises two components 20*a*, 20*b* which are connected to each other substantially centrally by means of a transverse carrier 21. The first mechanical rod assembly 50 is also constructed symmetrically relative to a longitudinal centre plane of the wall hugger recliner, the two sides being connected by means of a second transverse carrier 52. Accordingly, the second mechanical rod assembly 60 of the seat backrest adjustment mechanism 6 is also constructed in a mirror-symmetrical manner at both sides and connected to each other by means of a third transverse carrier 62. The first actuator 51 is arranged in this instance between the first transverse carrier 21 and the second transverse carrier 52 so that an actuation of the first actuator 51 leads to the first mechanical rod assembly 50 of the foot support adjustment mechanism 5, which rod assembly is articulated to the seat carrier 20, being adjusted with respect to the seat carrier 2 in the context of a deployment or retraction of the foot support 4. The second mechanical rod assembly 60 for adjustment of the seat 2 and backrest 3 is coupled to the fixed frame portion 10 in an articulated manner, an actuation of the second actuator 61 bringing about an adjustment of the seat 2 and backrest 3 (FIG. 1 and FIG. 2).

Figure 3A:
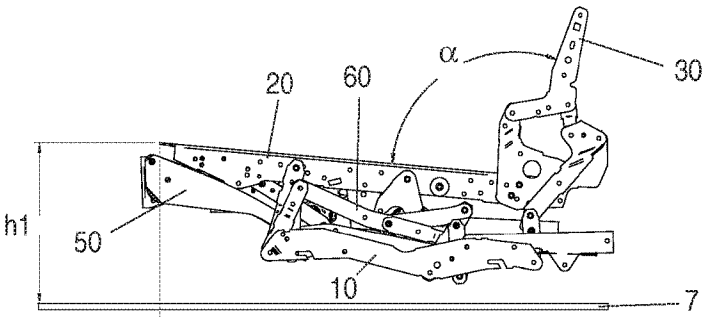
FIGS. 3*a*, 3*b*, 3*c*, 3*d*, 3*e*, and 3*f* are side views of the wall hugger recliner in different positions.

FIGS. 3*a* to 3*f* show the different positions which the wall hugger recliner can assume. FIG. 3*a* shows the upright basic position with the foot support retracted. The angle α between the seat and backrest is, for example, 105°±10°. The seat carrier 20 has in the front region thereof a spacing h1 from the floor 7 which is, for example, 260 mm±30 mm.

Figure 3B:
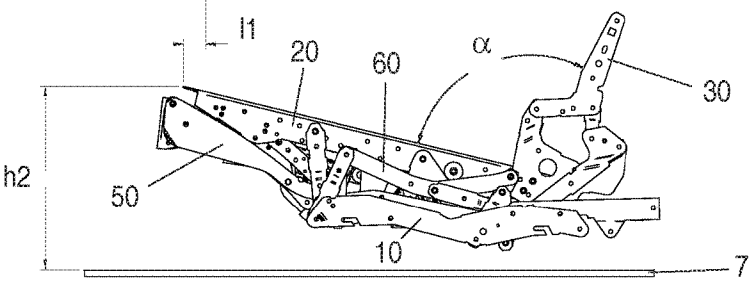

FIG. 3*b* shows a first intermediate position which is reached by actuation of the second actuator 61 of the seat backrest adjustment mechanism 6. In this instance, the second mechanical rod assembly 60 first brings about only a forward displacement of the seat or the seat carrier 20 and a simultaneous lifting of the front region. The backrest or the backrest carrier 30 is also carried in this instance, the angle between the seat and backrest remaining the same with respect to the upright basic position. The front region of the seat is in this instance pushed forward by L1 in the amount of for example 40 mm±10 mm. The height of the front region of the seat carrier 20 with respect to the floor 7 increases to h2 by, for example, 300 mm±30 mm. As a result of this movement, on the one hand, the backrest 3 is inclined with respect to the floor 7, but without significantly decreasing the spacing with respect to any rear wall which may be present. In order to achieve this, the forward displacement of the seat takes place. This type of synchronous movement of the seat and backrest is known in many cases from the prior art and is therefore not explained in greater detail.

The foot support adjustment mechanism 5 requires a clear spacing of the front end of the seat from the floor, which spacing is greater than the clear spacing available in the upright basic position according to FIG. 3*a* and smaller than the clear spacing available in the first intermediate position according to FIG. 3*b*. That is to say, the foot support cannot be deployed in the upright basic position according to FIG. 3*a* since it would otherwise come into contact with the floor and would be blocked.

Figure 3C:
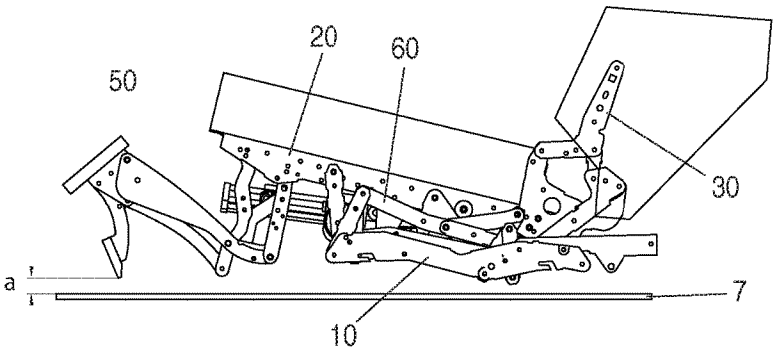

FIG. 3*c* shows the semi-deployed foot support by means of a corresponding actuation of the first actuator. It can be seen that in this position there is provided a spacing a between the foot support and the floor 7 which is advantageously selected to be only so large that a deployment or retraction of the foot support is still just possible without floor contact.

With conventional wall hugger recliners with a foot support which can be deployed, the foot support can also at any time in the upright basic position be pivoted outwards or inwards. As a result of the specific configuration of the wall hugger recliner shown here, although the actuation of the foot support may only be carried out in the intermediate position according to FIG. 3*b*, this has the advantage that the foot support can be constructed to be longer by the extent to which the front region of the seat is raised. In the embodiment illustrated, the foot support can consequently be extended by the dimension h2–h1. The comfort when the feet are set down is thereby increased. However, it would also alternatively be possible not to increase the foot support in terms of its length and instead to correspondingly lower the seat carrier and to convert the height gained thereby into a corresponding reinforcement of the seat upholstery.

Figures 3D, 3E, 3F:
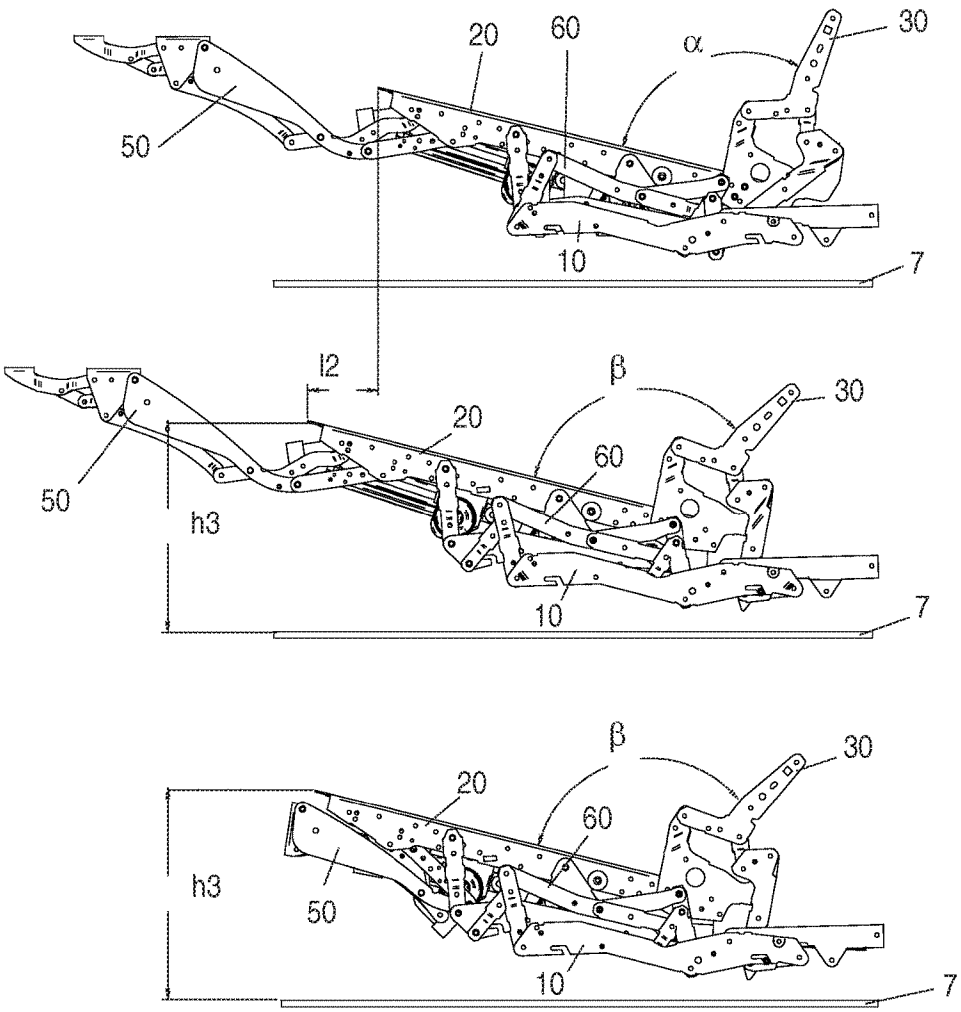

The fully deployed foot support is shown in FIG. 3*d*, with the angle α between the seat and backrest still being unchanged in this position. Only by further actuation of the second actuator of the seat backrest adjustment mechanism 6 is there an increase of the angle between the seat 2 and backrest 3 to an angle β, with β−α being, for example, 30°±15°. With this increase of the angle, the seat 2 or seat carrier 20 is again pushed forward by the dimension 12 so that the front end of the seat when the wall hugger recliner is moved from the upright basic position according to FIG. 3*a* into the horizontal position according to FIG. 3*e* is displaced in the direction of the front end thereof by 140 mm±30 mm.

The horizontal position according to FIG. 3*e* can also be achieved with the foot support retracted, starting from the intermediate position according to FIG. 3*b*, by only the second actuator 61 being actuated until the position according to FIG. 3*f* is reached.

Although in the embodiment illustrated the angle between the seat and backrest between the upright basic position according to FIG. 3*a* and the first intermediate position according to FIG. 3*b* is not changed, the seat backrest adjustment mechanism 6 can naturally also be constructed in such a manner that this angle already changes in this first adjustment phase.

Figure 4:
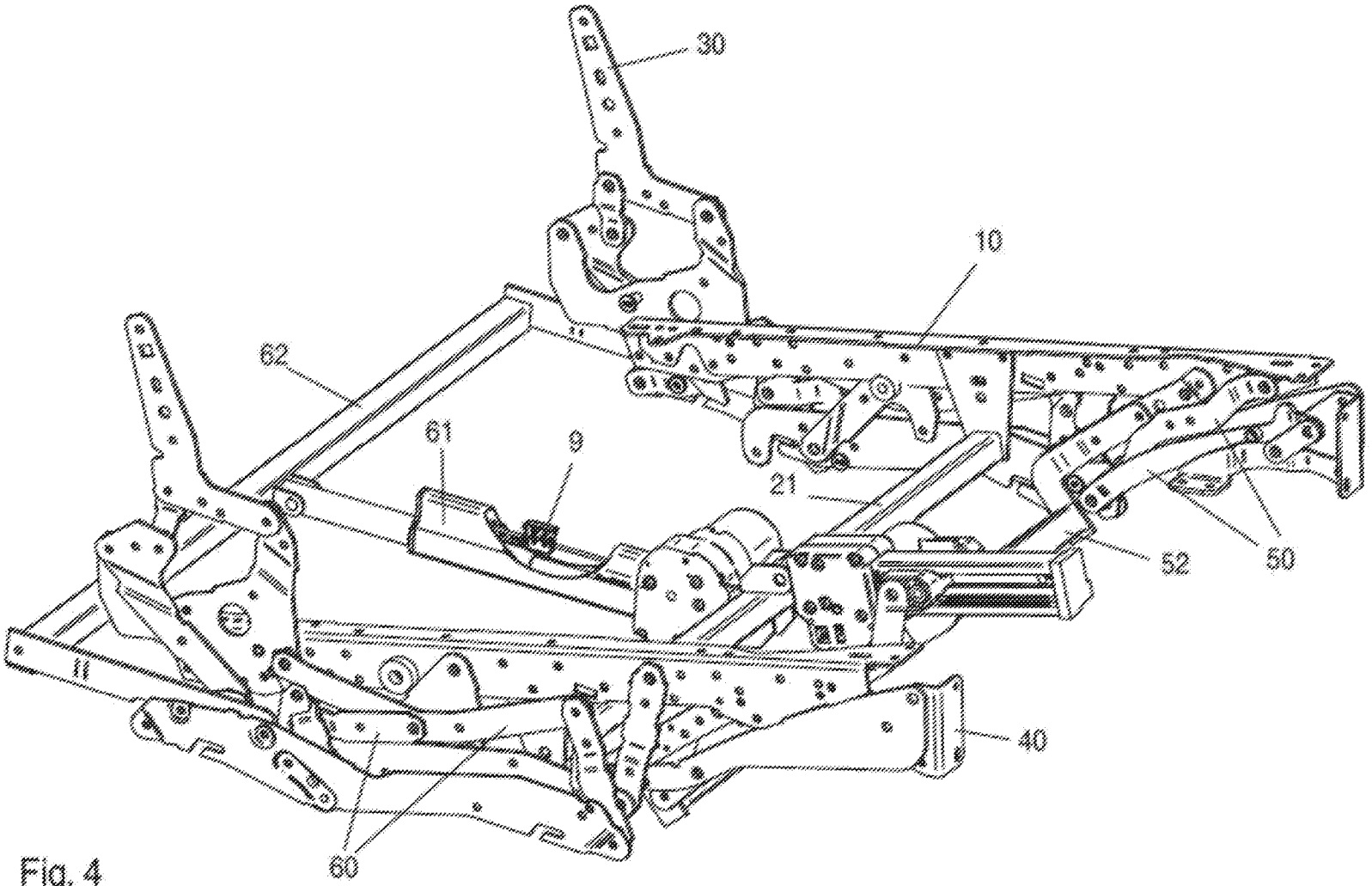
FIG. 4 is a schematic illustration of the adjustment mechanisms of the wall hugger recliner according to FIG. 1 with a sensor or switch arranged in the region of the motor.

In order to prevent the first actuator 51 for the foot support 4 being actuated in the upright basic position according to FIG. 3*a* or in a position between the two positions shown in FIG. 3*a* and FIG. 3*b*, there is provided a sensor or switch 8 (FIG. 1) which identifies whether the wall hugger recliner has already reached the intermediate position shown in FIG. 3*b* and consequently the spacing required to deploy the foot support is provided. In the embodiment according to FIG. 1, this switch is arranged in the region of the second mechanical rod assembly 60 of the seat backrest adjustment mechanism 6. Since the first intermediate position shown in FIG. 3*b* is achieved only by means of a corresponding actuation of the second actuator 61, it is in principle also conceivable for a corresponding sensor or switch 9 to be arranged in the region of the motor 61 as indicated in FIG. 4. By means of a control device which is not illustrated in greater detail, it is ensured that the first actuator 51 is released or can be activated only when the sensor or switch 8, 9 has identified that the first intermediate position according to FIG. 3*b* has been reached.

The invention claimed is:

1. A wall hugger recliner having a frame for placing on a floor, a seat, a backrest and a foot support and a foot support adjustment mechanism having a first mechanical rod assembly and a first actuator for deploying and retracting the foot support and a seat backrest adjustment mechanism having a second mechanical rod assembly for adjusting the seat and the backrest from an upright basic position into a horizontal position, wherein the seat backrest adjustment mechanism has a second actuator for adjusting the seat and the backrest, characterised in that the seat has a front end and the seat backrest adjustment mechanism enables the seat to be moved from the upright basic position into a first intermediate position, wherein the distance between the front end of the seat and the floor defines a clear spacing, and the clear spacing in the upright position is less than the clear spacing in the first intermediate position and wherein the clear spacing required to deploy and retract the foot support is greater than the clear spacing available in the upright basic position and less than the clear spacing available in the first intermediate position.

2. The wall hugger recliner according to claim 1, characterised by at least one sensor or switch which identifies whether the wall hugger recliner is located in a region between the upright basic position and the first intermediate position or in a region from the first intermediate position and the horizontal position.

3. The wall hugger recliner according to claim 2, characterised in that the at least one sensor or switch is operationally connected to the first actuator in order to deploy and retract the foot support for the release or blocking thereof.

4. The wall hugger recliner according to claim 2, characterised in that the at least one sensor or switch is fitted to the second actuator in order to adjust the seat and the backrest.

5. The wall hugger recliner according to claim 2, characterised in that the at least one sensor or switch is fitted to the second mechanical rod assembly of the seat backrest adjustment mechanism.

6. The wall hugger recliner according to claim 1, characterised in that the seat backrest adjustment mechanism, when the wall hugger recliner is moved from the upright basic position into the first intermediate position, brings about a displacement of the seat in the direction towards the front end thereof.

7. The wall hugger recliner according to claim 1, characterised in that the seat is provided with a first transverse carrier, whilst the foot support adjustment mechanism has a second transverse carrier and the first actuator is arranged between the first and second transverse carrier.

8. The wall hugger recliner according to claim 1, characterised in that the seat is provided with a first transverse carrier, whilst the seat backrest adjustment mechanism has a third transverse carrier and the second actuator is arranged between the first and third transverse carrier.

* * * * *